United States Patent [19]

Tibbitts

[11] Patent Number: 4,869,330

[45] Date of Patent: Sep. 26, 1989

[54] APPARATUS FOR ESTABLISHING HYDRAULIC FLOW REGIME IN DRILL BITS

[75] Inventor: Gordon A. Tibbitts, Salt Lake City, Utah

[73] Assignee: Eastman Christensen Company, Salt Lake City, Utah

[21] Appl. No.: 145,904

[22] Filed: Jan. 20, 1988

[51] Int. Cl.[4] ..... E21B 10/60

[52] U.S. Cl. ..... 175/393; 175/329

[58] Field of Search ..... 175/329, 393, 400, 412, 175/339

[56] References Cited

U.S. PATENT DOCUMENTS

| | | | |
|---|---|---|---|
| 3,272,704 | 4/1973 | Ablanalp | 175/329 |
| 3,322,218 | 5/1967 | Hildebrandt | 175/330 |
| 3,709,308 | 1/1973 | Rowley et al. | 175/329 |
| 4,655,303 | 4/1987 | Winters et al. | 175/329 |
| 4,727,946 | 3/1988 | Barr et al. | 175/393 X |
| 4,733,735 | 3/1988 | Barr et al. | 175/393 |
| 4,776,411 | 10/1988 | Jones | 175/393 |

FOREIGN PATENT DOCUMENTS

| | | | |
|---|---|---|---|
| 722509 | 11/1965 | Canada | 175/329 |
| 0169110 | 1/1986 | European Pat. Off. | 175/393 |
| 1366118 | 6/1964 | France | 175/329 |
| 711267 | 1/1980 | U.S.S.R. | 175/393 |
| 1033694 | 8/1983 | U.S.S.R. | 175/329 |

*Primary Examiner*—Jerome W. Massie IV
*Assistant Examiner*—David J. Bagnell
*Attorney, Agent, or Firm*—Arnold, White & Durkee

[57] ABSTRACT

A drill bit is provided which includes cutting elements cooperatively arranged with apertures in the bit to define flow paths for hydraulic flow proximate each cutting element. Cutting elements are preferably arranged in cutting pads which generally surround the apertures, such that hydraulic flow is forced to flow across the entire surface of the cutting pad. The dimensions of the cutting pad may be varied so as to control the hydraulic flow.

32 Claims, 6 Drawing Sheets

Fig.1
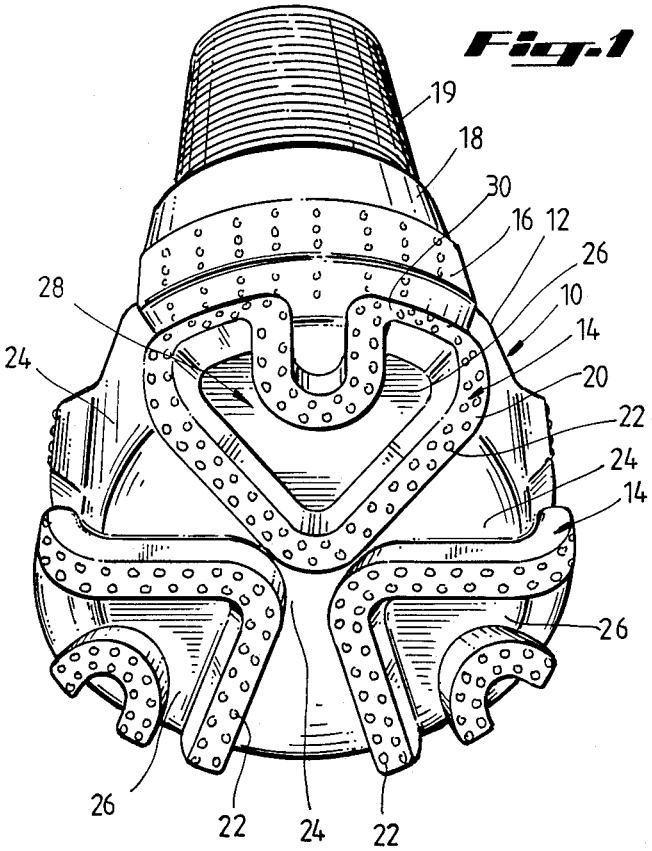
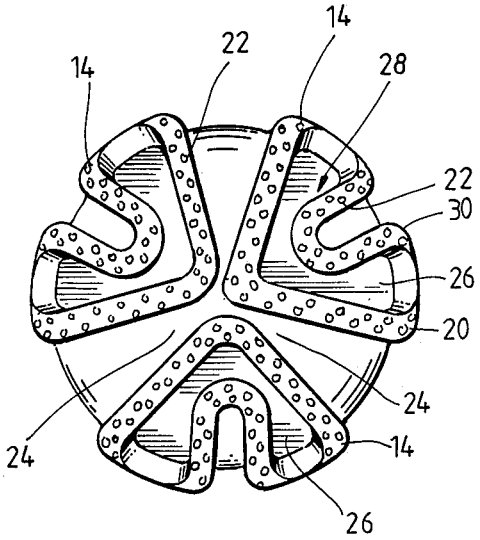
Fig.2
Fig.3A
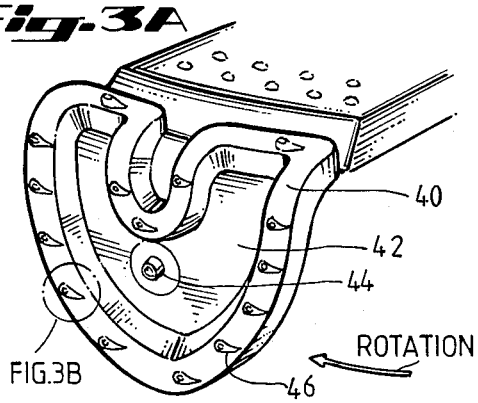
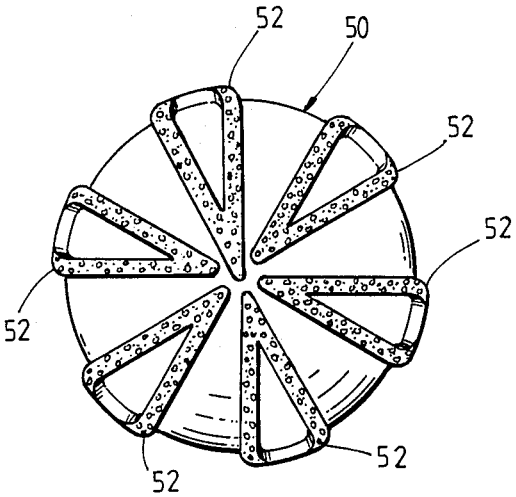
Fig.9
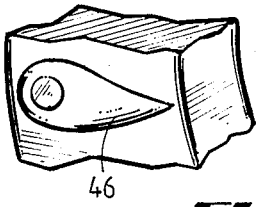
Fig.3B

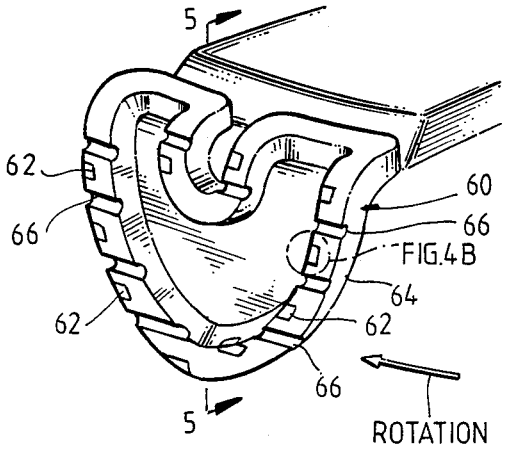
Fig.4A
Fig.4B
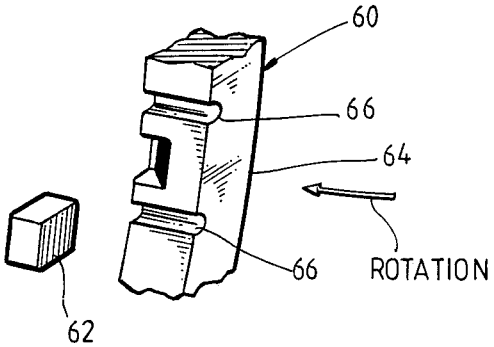
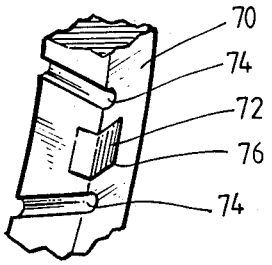
Fig.6
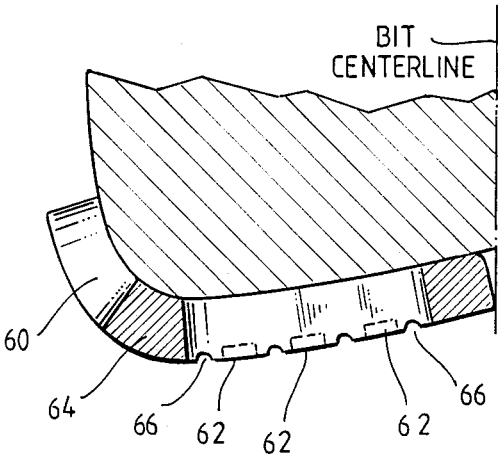
Fig.5
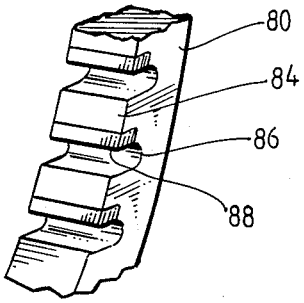
Fig.7

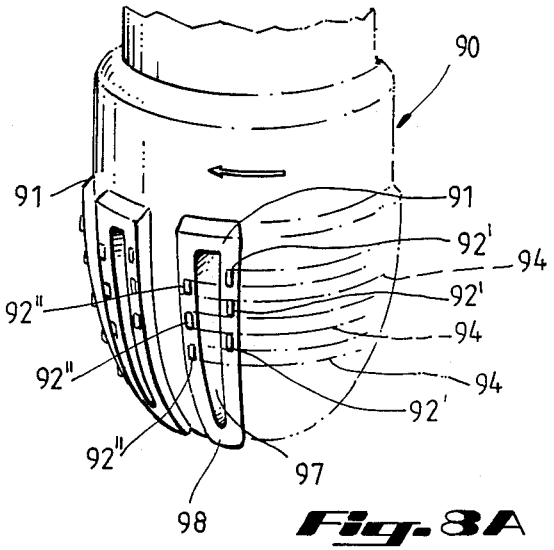
Fig. 3A
Fig. 3B
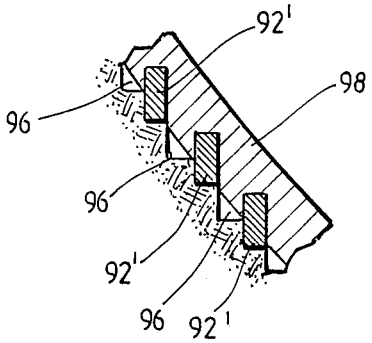
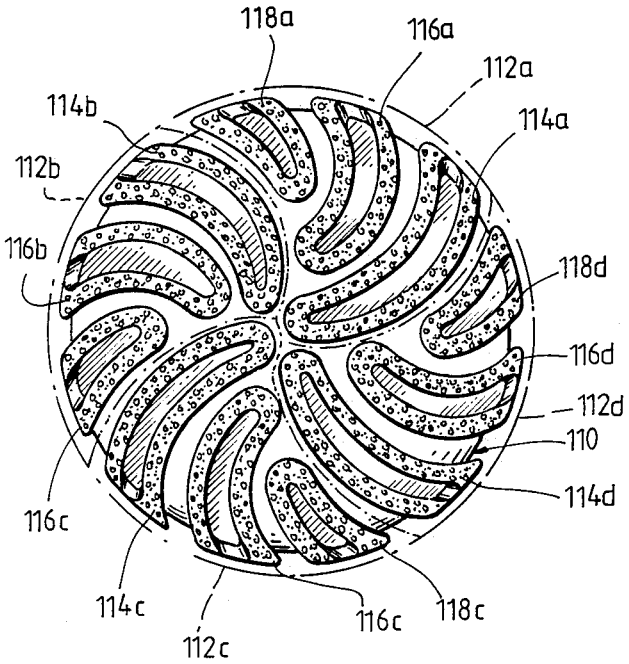
Fig. 13
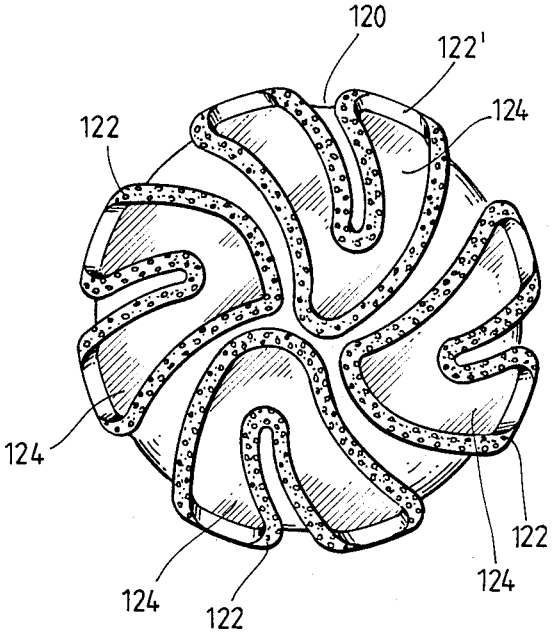
Fig. 14

APPARATUS FOR ESTABLISHING HYDRAULIC FLOW REGIME IN DRILL BITS

BACKGROUND OF THE INVENTION

The present invention relates generally to drill bits, and more specifically relates to methods and apparatus for establishing a hydraulic flow regime proximate selected portions of a drill bit.

The use of drill bits for the drilling of wells in earth formations or for taking cores of formations is well known. Bits for either purpose may include either stationary cutting elements for cutting or abrading the earth formation, or cutting elements mounted on rotating cones. Bits as presently known to the industry which utilize stationary cutting elements typically use either natural or synthetic diamonds as cutting elements and are known as "diamond bits". References herein to "diamond bits" or "diamond drill bits" refer to all bits, for either drilling or coring, having primarily stationary cutters.

Conventional diamond drill bits include a solid body having a plurality of cutting elements, or "cutters" secured therein. As the bit is rotated in the formation, the cutters contact and cut the formation. Hydraulic flow through the bit is utilized to cool the cutters of the bit and to flush cuttings away from the cutters and to the annulus. An important consideration in the design of diamond bits is the hydraulic performance of the bit. In conventional diamond bit design, hydraulic flow will exit the bit generally proximate the center of the bit and will flow generally radially outwardly through channels formed between the cutter faces. In some designs nozzles are utilized to direct the hydraulic flow directly proximate specified cutters. The hydraulic flow path, however, remains in a generally radially outward direction.

While such conventional designs are widely used today, difficulties are still encountered in maintaining a hydraulic flow which will efficiently and effectively cool and clean each cutter in the bit. In conventional bits the cutters which are proximate the point at which fluid exits from the interior of the bit are more effectively cooled than are cutters which are more remote from such location. Significant efforts have been made to design nozzles which will direct an appropriate proportion of the hydraulic flow at selected cutters in the bit to assure adequate cooling and operation. Such conventional designs, while performing satisfactorily, may not provide optimal cooling for each cutter.

One prior art attempt to distribute hydraulic energy across the face of the bit to cool the cutting elements is disclosed in U.S. Pat. No. 4,655,303 to Winters, et al. U.S. Pat. No. 4,655,303 discloses a drill bit having a central aperture through which hydraulic flow will emanate, and a plurality of radial channels extending from such aperture. The depth of each of these radial channels decreases as each channel widens along its outward path. Additionally, the extension of the diamond cutters above the surface of the bit decreases as a function of radial distance from the center of the bit. The intended function of these two design factors is to maintain a constant flow area available to the hydraulic flow regime across the radius of the bit, so as to maintain an established uniform pressure and flow across the face of the bit. This general technique has been utilized for a substantial period of time in the industry.

This type of design inherently includes many deficiencies. The design is not suitable for use with certain, particularly larger, types of cutters. The design is not practical for bits having multiple sizes of cutters, and the design requires the sizing of the cutters in a manner which, while possibly improving the hydraulic flow characteristics of the bit, may restrict the bit design to cutters which are sized and distributed in a manner which is less than optimal for cutting certain formations.

Accordingly, the present invention provides a new method and apparatus for controlling the hydraulic flow in a diamond drill bit whereby portions of the flow may be distributed uniformly across groups of cutting elements, and which is practical for use with a variety of types and sizes of cutting elements.

SUMMARY OF THE INVENTION

Drill bits in accordance with the present invention include a body section which includes one or more apertures to facilitate hydraulic flow through the bit. Cutting elements are cooperatively arranged with the apertures and with flow channels on the body of the bit to define flow paths for hydraulic flow proximate each cutting element. In a preferred embodiment, cutting elements are cooperatively arranged with relatively elevated portions of the body section to provide cutting pads which cooperatively serve to define a flow path for hydraulic flow past each of the cutting elements. Also in a preferred embodiment, the cooperative design of the cutting elements and the lands serves to provide a desired hydraulic flow around the cutting pad. In at least one particularly preferred embodiment, elevated lands will be distributed around one or more apertures to generally surround the aperture. Cutting elements will then be affixed to either project from or lie securely against, the surface of these lands.

BRIEF DESCRIPTION OF THE DRAWINGS

FIG. 1 depicts a drill bit in accordance with the present invention, illustrated in an upward-looking perspective view.

FIG. 2 depicts the drill bit of FIG. 1 from a bottom plan view.

FIGS. 3A–B depict an alternative embodiment of a cutting pad in accordance with the present invention, illustrated in a perspective view.

FIGS. 4A–B depict an alternative embodiment of a cutting pad for use on a drill bit in accordance with the present invention, depicted in FIG. 4A in a perspective view and in FIG. 4B in a segmented exploded view.

FIG. 5 depicts the cutting pad of FIG. 4A in vertical section.

FIG. 6 depicts an alternative configuration of a cutting pad in accordance with the present invention.

FIG. 7 depicts another alternative embodiment of a cutting pad in accordance with the present invention.

FIGS. 8A–B depict another alternative embodiment of a cutting pad in accordance with the present invention, depicted in FIG. 8A in a perspective view and in FIG. 8B in a segmented vertical section view.

FIG. 9 depicts an alternative embodiment of a drill bit and cutting pads in accordance with the present invention.

FIG. 14 depicts another alternative embodiment of a drill bit in accordance with the present invention, illustrated from a bottom plan view.

FIG. 18 depicts another alternative embodiment of a drill bit in accordance with the present invention, illustrated from a side view.

DETAILED DESCRIPTION OF PREFERRED EMBODIMENTS

Figure 10:
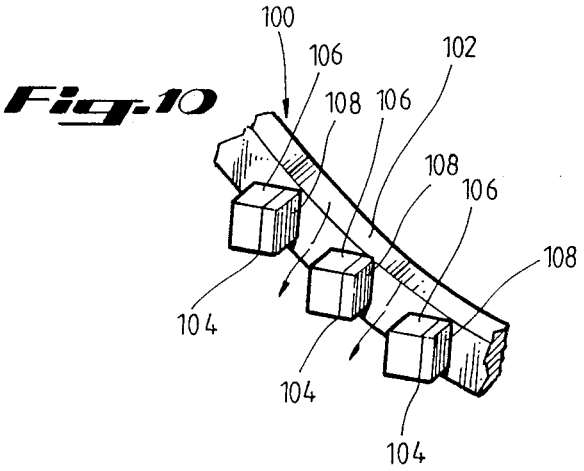
FIG. 10 depicts an alternative arrangement of cutters on a cutting pad in accordance with the present invention.

Referring now to FIGS. 1 and 2, therein is depicted an exemplary embodiment of a drill bit 10 in accordance with the present invention. Drill bit 10 includes a body 12 which includes cutting pads, indicated generally at 14, and gage pads, indicated generally at 16. Gage pads 16 may serve a cutting function, but normally would not unless extending radially beyond those portions of cutting pads 14 extending to the gage. Body 12 is preferably a molded component fabricated through conventional metal matrix infiltration technology. Body 12 is coupled to a shank 18 which includes a threaded portion 19. Shank 18 and body 12 are preferably formed to be functionally integral with one another. Drill bit 10 includes an internal recess (not illustrated), through which hydraulic flow will flow.

Each cutting pad 14 is formed of a continuous land 20 which includes a plurality of surface-set diamond cutting elements 22 secured thereto. Diamond cutting elements 22 are preferably embedded in the matrix of body 12 and project a desired distance from the surface of continuous land 20. Surrounding each continuous land 20 are channels or recesses 24. In this embodiment, recesses 24 represent nominal contours of body 12, relative to which continuous lands 20 are elevated. Body 12 includes apertures 26 within the interior of each continuous land 20. Each aperture 26 provides a path for hydraulic flow from the interior to the exterior of drill bit 10. The relative elevation of continuous lands 20 provides a flow area adjacent the periphery of each land 20.

In the embodiment of FIGS. 1 and 2, each continuous land 20 is formed in a generally "wedge shape," with an inwardly extending leg, indicated generally at 28, approaching the central axis of drill bit 10 from a central portion along the outer periphery 30 of the wedge. As can be clearly seen in FIG. 2, this conformity places an increased area of land 20, and therefore of cutting elements 22, proximate the outer radial portion of bit 10. Accordingly, because the outermost portions of the radius of a diamond drill bit are subjected to increased abrasion and wear relative to inner portions along the radius, drill bit 10 provides an increased density of cutting elements to optimize distribution of such abrasion and wear. In FIG. 2 it can be seen that one cutting pad 14' extends to the center of drill bit 10 to assure full coverage of a cutting surface across the face of bit 10.

Additionally, as can be seen in FIG. 1, cutting pads 14 extend from the bottom cutting surface of bit 10 around to the gage cutting surface. Accordingly, bit 10 provides for dedicated hydraulic flow across cutters cutting the gage of the borehole. In some applications where particular deflection of the bit from the gage of the borehole is anticipated, such as in navigational drilling, it may be desirable to increase the widths of continuous lands 20 on the gage of the bit relative to other locations to maintain optimal hydraulic flow characteristics around the surface of cutting pad 14.

During the use of drill bit 10 in a drilling operation, fluid will be pumped down the drill string and out apertures 26 in drill bit 10 to cool cutting elements 22 and to flush the cuttings uphole. The hydraulic flow will typically be pumped at a level such as 500 to 3000 psi above the hydrostatic pressure at the bit. The pressure existing in recesses or channels 24 adjacent cutting pads 14 will be generally at hydrostatic pressure. Because the formation being penetrated by drill bit 10 will have a contour which complements that of bit 10, continuous lands 20 function, with the earth formation, to form a restriction to fluid flow which is, in this embodiment, generally constant. The pressure drop of the drilling fluid to hydrostatic pressure is, therefore, also generally uniform around continuous lands 20. Accordingly, the hydraulic flow will be generally uniform around the surface of continuous lands 20, and by each cutting element 22. Accordingly, the arrangement of continuous lands 20 around hydraulic flow apertures 26 allows for a portion of the hydraulic flow from each aperture 26 to be distributed to each set of cutters on the respective land 20.

Referring now to FIGS. 3A–B, therein is depicted an alternative construction of a cutting pad 40 for a drill bit in accordance with the present invention. FIG. 3A depicts a cutting pad land 40 which is conformed similarly to cutting pads 14 of the embodiment of FIGS. 1 and 2 with the exception that cutting pads 14 include cutting elements 46 which are thermally stable, synthetic diamond cutters. Additionally, cutting pad 40 encloses a recess 42 which includes an aperture formed by a nozzle 44. Thus, in contrast to the embodiment of FIG. 1, hydraulic flow will not exit through a relatively large aperture (26 in FIG. 1), but will be directed into recess 42 by nozzle 44. Nozzle 44 may be utilized to control hydraulic flow requirements of cutting pad 40, and may, in some instances, be utilized to direct flow within aperture 42 to optimize cutting element cleaning. As with the embodiment of FIGS. 1 and 2, hydraulic flow will travel across continuous land 42 and around individual cutting elements 46. Cutting elements 46 may be placed as desired to establish the desired hydraulic flow and cutting element distribution.

Referring now to FIGS. 4A–B and 5, therein is depicted another alternative cutting pad 60 for a drill bit in accordance with the present invention. Cutting pad 60 includes a plurality of cutting elements 62 retained in the leading-facing surfaces of continuous land 64. A plurality of flow channels 66 are distributed across the width of continuous land 64. Flow channels 66 are preferably distributed with one on each side of each individual cutting element 62. Cutting pad 60 surrounds a central aperture 68. In this embodiment, hydraulic flow will pass from central aperture 68 across cutting pad 60, primarily through flow channels 66. Flow will therefore be established proximate each cutting element 62, thereby facilitating cooling and cleaning of each cutting element. FIG. 5 depicts cutting pad 60 in horizontal section along line 5—5 in FIG. 4A.

Referring now to FIGS. 6 and 7, therein are depicted alternative cooperative arrangements between cutting elements and flow channels which may be utilized in bits in accordance with the present invention. The embodiment of FIG. 6 is similar to that of FIG. 4A, in that land 70 has a cutting element 72 retained proximate its leading face and that cutting element 72 is flanked on each side by a flow channel 74. However, flow channels 74 are oriented so as to be convergingly aligned relative to cutting element 72. Accordingly, hydraulic flow through channel 74 will converge proximate face 76 of cutting element 72 and will evidence relatively increased turbulence proximate face 76 of cutting element 72 to improve cleaning and cooling of cutting element 72.

FIG. 7 depicts a configuration where cutting pad 80 includes cutting elements 88 retained on land 84 immediately adjacent flow channels 86. Cutting elements 88 and flow channels 86 each extend across the width of land 84. Cutting elements 88 and flow channels 86 may be at any desired position relative to the radius of the bit, from generally perpendicular to the radius of the bit to generally parallel to the radius of the bit. Additionally, cutting elements 88 may be angled or contoured in any desired manner. The arrangement of cutting element 88 immediately adjacent flow channels 86 assures that there is a direct flow path along each cutting element 88.

Referring now to FIGS. 8A–B, there is depicted a bit 90 including a cutting pad 91 for a drill bit in accordance with the present invention which, again, includes a plurality of cutting elements all generally designated as 92 arranged on continuous lands 96. Each cutting element 92 is radially offset relative to the cutting element 92 which it follows when bit 90 is rotated within a formation. For example, each cutting element 92' is offset from its preceding cutting element 92'', as shown by radius lines 94. As can best be seen in FIG. 8B, by such arrangement, a flow channel 94 is formed past continuous land 98, and proximate cutting element 92 in the cut (or channel) 96 formed by the preceding cutting element. As a cutting element (for example 92'') cuts the formation, it leaves a cut or channel 96. The next cutting element (for example 92') will follow proximate channel 96. Because there is essentially no fluid path provided in bit 90 from aperture 97 across cutting pad 91, the channels 96 left by preceding cutters will form flow paths for the hydraulic flow.

FIG. 9 depicts another alternative embodiment of a drill bit 50 in accordance with the present invention. Drill bit 50 includes a plurality of generally wedge-shaped cutting pads 52 which extend from proximate the longitudinal axis of bit 50 to the gage of bit 60. As depicted, cutting pads 52 themselves form impregnated matrix cutters. Impregnated matrix cutters include small diamond stones, such as, for example, 25–35 mesh stones, in an abradable matrix.

In some applications, cutting pads 52 may include flow channels across their width as pressure reliefs to assure that the hydraulic pressure differential across cutting pads 52 does not exceed desirable levels. As with previous designs of bits, one cutting pad 52' extends across the center of bit 50 to assure full face coverage. As will be apparent to those skilled in the art, cutting pads 52 do not have to be formed as impregnated matrix cutters, as conventional cutting elements of any appropriate type could be arranged on bit 50.

Figure 11:
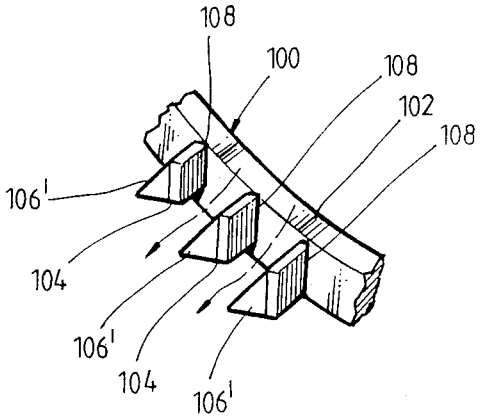
FIG. 11 depicts another alternative arrangement of cutters on a cutting pad in accordance with the present invention.

FIGS. 10 and 11 show two arrangements for cutting elements on a cutting pad in which the cutting elements are elevated above the surface of the cutting pad. In FIG. 11, cutting pad 100 includes land 102 which has a plurality of cutting elements 104 secured thereto through use of backing segments 106. Backing segments 106 may be molded extensions which are integral with land 102, or may be backing slugs on which the cutting elements are mounted and which, in turn, are set within the body of the drill bit. The arrangement of cutting pad 100 allows fluid flow directly across the cutting face 108 of each cutting element 104. The embodiment of FIG. 11 is functionally identical to that of FIG. 10, with the exception that backing segment 106' has been reduced in dimension across a diagonal, thereby allowing cutting elements 104 to be placed closer to one another while still facilitating full fluid flow across face 108 of each cutting element 104.

Figure 12A:
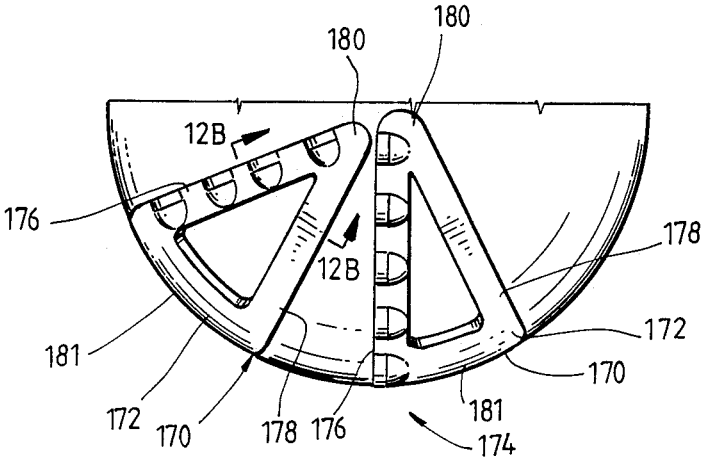
FIGS. 12A–B depict another alternative embodiment of a cutting pad for use on a drill bit in accordance with the present invention.
Figure 12B:
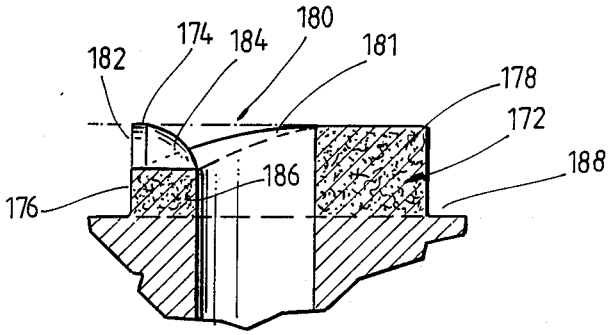

Referring now to FIGS. 12A–B, therein is depicted yet another alternative embodiment of cutting pad 170 in accordance with the present invention. Each cutting pad again includes a continuous land 172 having a plurality of cutting elements 174 arranged thereon. In the illustrated embodiment, cutting elements 174 are polycrystalline diamond cutters presenting a generally hemispherical exposed cutting surface. In the depicted embodiment, continuous land 172 is graduated between two sections of varying heights 176 and 178, respectively. Lower height section 176 is on the leading side of continuous land 172 and includes cutting elements 174. Transitional sections 180, 181 leading to upper height section 178 are on the radially inner and outer portions of pad 172. In this embodiment, upper height section 178 of continuous land 172 does not include any cutting elements. Additionally, upper heigth section 178 of continuous land 172 is of an increased width relative to the width of lower heigth section 176.

In the illustrated embodiment, cutting elements 174 are preferably comprised of a polycrystalline synthetic diamond table 182, mounted, bonded or otherwise fixed to a metallic backing slug 184 although other types of cutting elements, such as natural diamonds or thermally stable synthetic diamonds, may be employed in lieu of or in combination with the cutting elements as shown. The metallic backing slug 184 is in turn set within continuous land 172 as a part of the infiltration molding process. These cutters 174 present a relatively high exposure relative to the nominal surface 188 of the bit. Accordingly, higher portion 178 of continuous land 172 (with increased width as well as heigth), serves as a "dam" which effectively closes the path for hydraulic flow to areas other than those proximate cutting elements 174. Thus, notwithstanding the relatively high exposure of cutters 174, adequate hydraulic pressure and flow may be maintained proximate cutters 174. Land 172 will preferably be formed, at least in part, of an abradable matrix which will wear as cutting elements 174 wear, and may itself include cutting elements thereon, such as natural diamonds, diamond grit or thermally stable synthetic diamonds, all of such being known and commercially available. For example, land 172 is depicted as being formed of an abradable matrix cutter as previously described herein with respect to FIG. 9.

It should be readily understood that although a cutting pad of varying heights and widths is described in combination with polycrystalline diamond cutters, such varying pad dimensions may be utilized to control and regulate fluid dynamics with a variety of cutting elements types and designs.

FIGS. 13–18 depict alternative shapes, and distributions of shapes, of cutting pads which may be utilized in drill bits in accordance with the present invention. One skilled in the art will recognize that these exemplary embodiments shown are illustrative only, and that a virtually infinite number of cutting pad configurations may be utilized within the scope of the present invention. The embodiments of FIGS. 13–17 are depicted as including natural diamond cutting elements. Alternatively, these embodiments could include other types of cutting elements and or flow channels, including those exemplary configurations depicted in FIGS. 1–12.

Although each exemplary embodiment depicted herein, with the exception of the embodiment of FIG. 3A, depicts hydraulic flow apertures which extend to the boundaries of the cutting pad or land which surrounds them. It should be readily understood that these apertures may be singularly smaller, or may be divided into a plurality of smaller apertures within the pad, so as to control the hydraulic flow regime. For example, the sizes of apertures within various cutting pads on a bit may be utilized to regulate the proportion of the total hydraulic flow which is dedicated to that cutting pad. For example, smaller apertures might be placed within gage cutting pads to provide sufficient but reduced fluid flow relative to the flow dedicated to cutting pads cutting the bottom of the hole.

Figure 13:
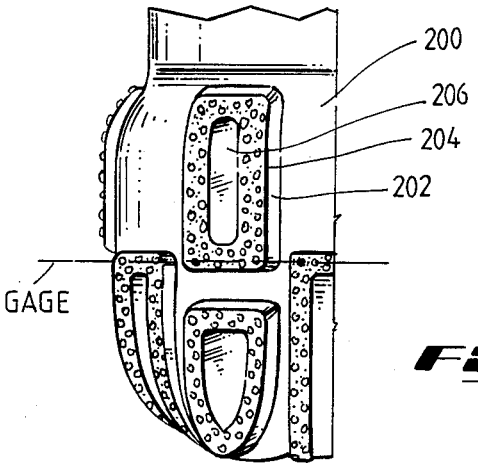
FIG. 13 depicts an alternative embodiment of a drill bit in accordance with the present invention, illustrated from a bottom plan view.
Figure 15:
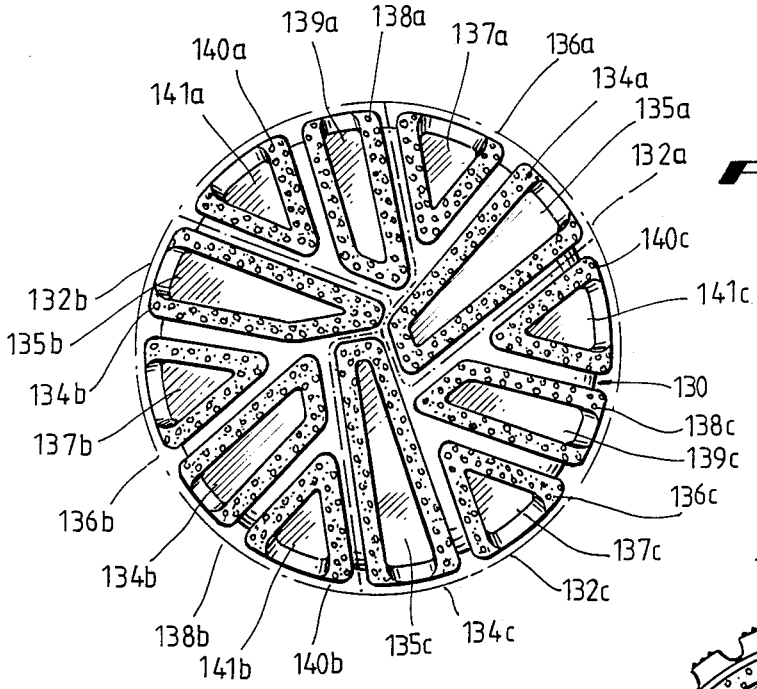
FIG. 15 depicts another alternative embodiment of a drill bit in accordance with the present invention illustrated from a side view.

FIGS. 13–15 depict bits in accordance with the present invention from an inverted plan view, i.e., looking directly at the bottom of the bit. FIG. 13 depicts a bit 110 which includes cutting pads arranged in four sets 112(*a–d*), each including three similarly-shaped cutting pads, 114(*a–d*), 116(*a–d*) and 118(*a–d*). Each cutting pad 114, 116, 118 presents a generally curvilinear or spiraled profile to the radius of bit 110.

Each set of cutting pads 112*a–d* is substantially similar, with the major exception that one cutting pad 114*a* will be conformed to extend to cut the area proximate the longitudinal axis of bit 110. Each cutting pad 114, 116, 118 preferably extends to the gage of bit 110. Additionally, each cutting pad 114, 116, 118 surrounds a central aperture 115, 117, 119 from which the hydraulic flow will emanate. Each cutting pad 114, 116, 118 is elevated relative to the remaining general contour of bit 110, i.e., those portions connecting elevated cutting pads 114, 116, 118.

FIG. 14 depicts a bit 120 having cutting pads 122 similar to those of bit 10 of FIG. 1, with the exception that cutting pads 122 are conformed to exhibit generally curvilinear, or spiraled, surfaces to the radius of bit 120. Cutting pads 122 again surround central apertures 124. At least one cutting pad 122' is conformed to extend to the central or rotational axis of bit 120.

FIG. 15 depicts a bit 130 which includes three cooperating sets of cutting pads 132*a–c*, each set including four cutting pads, 134(*a–c*), 136(*a–c*), 138(*a–c*), 140(*a–c*). Cutting pads in each set are generally similar, with the exception that cutting pads 134*a*, 134*b* and 134*c* will have different conformities at their innermost portions to enable each pad 134*a*, 134*b* and 134*c* to present a cutting surface to the rotational axis of bit 130. As with previous embodiments, each cutting pad 134, 136, 138, 140 is generally continuous and surrounds a central aperture, 135(*a–c*), 137(*a–c*), 139(*a–c*), 141(*a–c*).

Figure 16:
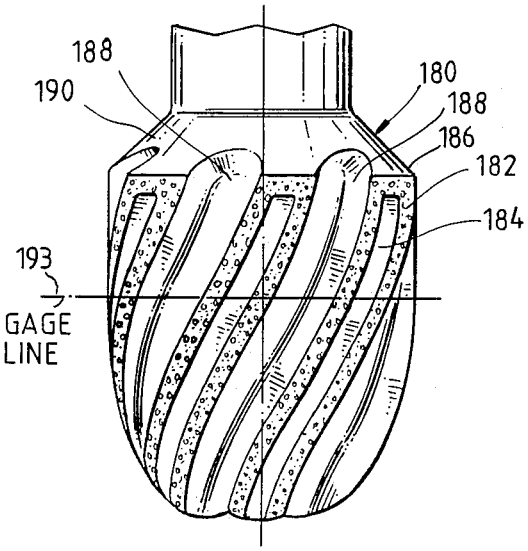
FIG. 16 depicts another alternative embodiment of a drill bit in accordance with the present invention illustrated from a side view.

FIG. 16 depicts a drill bit 180 in accordance with the present invention. Drill bit 180 includes a plurality of cutting pads 182 which may be considered to form cutting surfaces which are generally spiraled around the bottom and gage periphery of drill bit 180. Each cutting pad 182 again surrounds a central aperture 184. Drill bit 180 includes cutting pads 182 which may be considered to form the general contours of the lower portion of bit body 186. Accordingly, bit body 186 includes grooves or channels 188 adjacent the outer periphery of cutting pads 182. Upper chamfer section 190 of bit body 186 again provides a relative recess for fluid flow adjacent the outer periphery of cutting pads 182. Accordingly, during operation of bit 180 fluid within relative recesses 188, 190 will be generally at hydrostatic pressure thereby allowing optimal fluid distribution around cutting pads 182.

Additionally, bit 180 demonstrates another embodiment of a bit providing dedicated hydraulic flow proximate cutters cutting the gage, i.e., those cutters above gage line 192. The extension of cutting pads 182 and central apertures 184, and recesses 188, both above and below gage line 192, coupled with chamfer 190 serve to provide hydraulic flow across the face of the gage cutting elements.

Figure 17A:
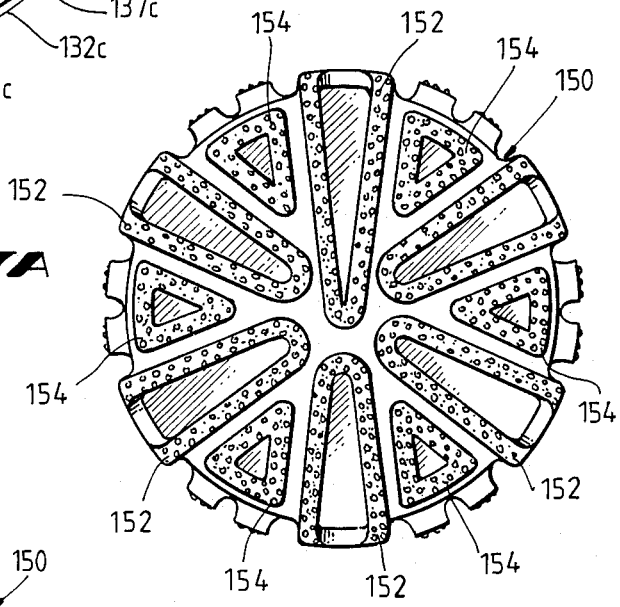
FIGS. 17A–B depict another alternative embodiment of a drill bit in accordance with the present invention illustrated in FIG. 17A from a bottom plan view, and in FIG. 17B from a side view.
Figure 17B:
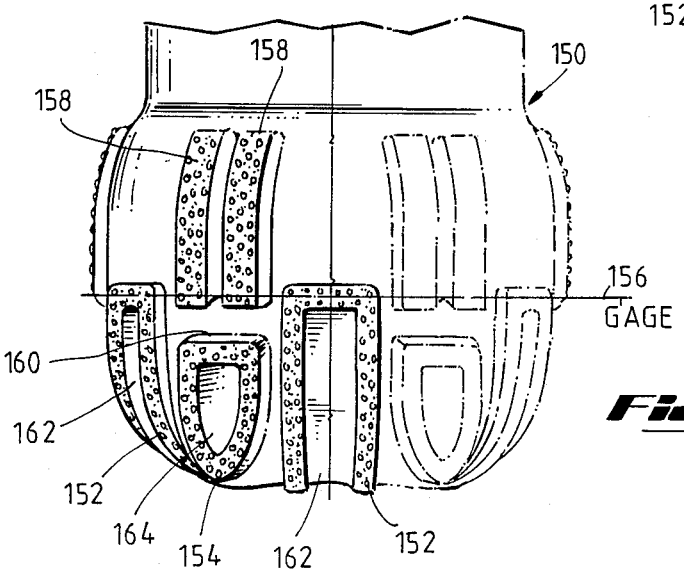

FIGS. 17A–B depict yet another alternative embodiment of a bit 150 in accordance with the present invention. Bit 150 includes a plurality of, and preferably six, radially extending cutting pads 152 which extend both along the bottom surface of the bit and to the gage 156 of bit 150. One of these cutting pads 152' will be extended to cover the rotational axis of bit 150. Situated between each adjacent radially-extending cutting pad 152 is a generally wedge-shaped cutting pad 154 which cuts only on the downward surface of the bit and not the gage. Distinct gage cutters 158 are oriented along the gage of bit 150 longitudinally disposed above outer portions 160 of continuous lands 154. Each cutting pad 152, 154 encloses a central aperture, 162, 164 respectively. The provision of bottom-cutting cutting pads 154 serves to increase cutting element coverage along the radially outward portion of bit 150.

Referring now to FIG. 18, therein is depicted an alternative embodiment of bit 200 including gage cutters 202 with dedicated hydraulic flow. Gage cutters 202 are each formed of a raised cutting pad 204 surrounding a central gage aperture 206. Gage cutting pads 204 serve to provide optimal hydraulic flow characteristics to the gage cutters, rather than their being left to cooling from incidental flow around bit 200, as is typical with conventional designs.

Many modifications and variations may be made in the techniques and structures described and illustrated herein without departing from the scope of the present invention. For example, in addition to the placing of nozzles within the perimeter of the cutting pads, nozzles may be oriented at desired locations on the exterior of the cutting pads. Additionally, bits may be constructed to include both cutting pads with a dedicated hydraulic flow as described herein and conventionally irrigated cutters subjected to either radial or nozzle-oriented hydraulic flow. Further, cutting pads incorporating more than one type of cutting element and bits having a plurality of cutting pads thereon, each having a single type of cutting element but different than the cutting elements on at least one other pad, are contemplated as within the scope of the present invention. Accordingly, the techniques and structures described and illustrated herein are exemplary only and are not to be considered as limitations on the present invention.

I claim:

1. A drill bit, comprising:
a body member, said body member including at least one aperture therethrough;
a generally continuous land surrounding said aperture, said continuous land conformed to provide a restriction to fluid flow when said drill bit is operated within a borehole;
a plurality of cutting elements cooperatively arranged with said generally continuous land; and
a plurality of flow channels formed across said generally continuous land so that hydraulic flow from said aperture will flow proximate individual elements of said plurality of cutting elements.

2. The drill bit of claim 1, wherein said body member includes a plurality of apertures and a plurality of generally continuous lands, and wherein each of said generally continuous lands generally surrounds one or more of said apertures.

3. The drill bit of claim 1, wherein said generally continuous land includes an increased surface area proximate an outer radial portion of said drill bit relative to the surface area of said generally continuous land proximate an inner radial portion of said drill bit.

4. The drill bit of claim 1 , wherein said generally continuous land is elevated relative to the portion of said drill bit adjacent the outer periphery of said generally continuous land.

5. The drill bit of claim 1, wherein said generally continuous land extends along a bottom cutting portion and along the gage of said drill bit.

6. The drill bit of claim 1, wherein said drill bit comprises cutters to cut along the gage of said drill bit, and wherein said gage cutters are placed on said generally continuous land.

7. The drill bit of claim 1, wherein said drill bit comprises a plurality of apertures, and wherein said drill bit further comprises a plurality of generally continuous lands surrounding at least one of said apertures, and wherein each generally continuous land includes a plurality of cutting elements cooperatively arranged with said generally continuous land, and a plurality of flow channels formed in each of said generally continuous lands to provide hydraulic flow from said respective apertures proximate each cutting element of said plurality of cutting elements.

8. The drill bit of claim 7 wherein at least one of said generally continuous lands is adapted to cut along the gage of said drill bit.

9. The drill bit of claim 1, wherein said generally continuous land includes a plurality of flow channels.

10. The drill bit of claim 1, wherein said generally continuous land varies in height relative to portions of said drill bit adjacent the outer periphery of said continuous land.

11. The drill bit of claim 1, wherein said cutting elements comprise synthetic diamond cutting elements.

12. The drill bit of claim 11, wherein said synthetic diamond cutters are retained in a sintered matrix.

13. The drill bit of claim 1, wherein each of said flow channels lies immediately adjacent one cutting element of said plurality of cutting elements.

14. The drill bit of claim 1, wherein said apertures is in the form of a nozzle.

15. The drill bit of claim 1, wherein said plurality of flow channels are distributed with one of said flow channels on each side of each cutting element.

16. The drill bit of claim 15, wherein said flow channels on each side of each of said cutting elements converge toward one another at the outer periphery of said generally continuous land.

17. A drill bit, comprising:
a body member, said body member including at least one aperture therethrough;
a generally continuous land surrounding said aperture, said continuous land conformed to provide a restriction to fluid flow when said drill bit is operated within a borehole;
a plurality of flow channels formed across said generally continuous land; and
a plurality of cutting elements cooperatively arranged at least partially within the flow channels of said generally continuous land whereby hydraulic fluid from said aperture flows through said plurality of flow channels to each cutting element of said plurality of cutting elements.

18. The drill bit of claim 17, wherein said body member includes a plurality of apertures and a plurality of generally continuous lands, and wherein each of said generally continuous lands generally surrounds one or more of said apertures.

19. The drill bit of claim 17, wherein said generally continuous land includes an increased surface area proximate an outer radial portion of said drill bit relative to the surface area of said generally continuous land proximate an inner radial portion of said drill bit.

20. The drill bit of claim 17, wherein said generally continuous land is elevated relative to the portion of said drill bit adjacent the outer periphery of generally continuous land.

21. The drill bit of claim 17, wherein said generally continuous land extends along a bottom cutting portion and along the gage of said drill bit.

22. The drill bit of claim 17, wherein said drill bit further comprises:
a plurality of apertures through said body member;
a plurality of generally continuous lands surrounding at least one of said apertures;
a plurality of flow channels formed across each of said generally continuous lands;
a plurality of cutting elements cooperatively arranged within the flow channels of said generally continuous lands whereby hydraulic fluid from respective apertures flows through said plurality of flow channels to each cutting element of said plurality of cutting elements.

23. The drill bit of claim 22, wherein at least one of said continuous lands is adapted to cut along the gage of said drill bit.

24. The drill bit of claim 17, wherein said generally continuous land varies in height relative to portions of said drill bit adjacent the outer periphery of said continuous land.

25. The drill bit of claim 17, wherein said aperture includes a nozzle.

26. A drill bit, comprising:
a body member having at least one aperture extending therethrough, said aperture being adapted to pass fluid;

a generally continuous land surrounding said aperture, and being elevated relative to selected adjacent portions of said body member, said land having a first portion and a second portion, said first portion being lower than said second portion; and a plurality of cutting elements arranged on said first portion of said land, whereby said higher, second portion of said land directs fluid flow from said aperture across said first portion of said land and said cutting elements arranged thereon.

27. The drill bit of claim 26, wherein said second portion of said land is wider than said first portion of said land.

28. The drill bit of claim 26, wherein said second portion of said land includes an abrading surface.

29. The drill bit of claim 26, wherein said body member includes a plurality of apertures and a plurality of generally continuous lands, and wherein each of said generally continuous lands generally surrounds one or more of said apertures.

30. The drill bit of claim 26, wherein said generally continuous land includes an increased surface area proximate an outer radial portion of said drill bit relative to the surface area of said generally continuous land proximate an inner radial portion of said drill bit.

31. The drill bit of claim 26, wherein said generally continuous land extends along a bottom cutting portion and along the gage of said drill bit.

32. The drill bit of claim 26, wherein said aperture includes a nozzle.

* * * * *